US005600416A

United States Patent [19]

Hart

[11] Patent Number: 5,600,416

[45] Date of Patent: Feb. 4, 1997

[54] ELECTRODE WIRE TENSIONING FOR SCAVENGELESS DEVELOPMENT

[75] Inventor: Steven C. Hart, Webster, N.Y.

[73] Assignee: Xerox Corporation, Stamford, Conn.

[21] Appl. No.: 568,106

[22] Filed: Dec. 6, 1995

[51] Int. Cl.[6] ..... G03G 15/08

[52] U.S. Cl. ..... 399/291; 140/123.5

[58] Field of Search ..... 355/247, 261–263, 355/265; 118/654, 647–651; 140/123.5, 2, 108

[56] References Cited

U.S. PATENT DOCUMENTS

| | | | |
|---|---|---|---|
| 2,322,137 | 6/1943 | Jauch . | |
| 2,681,580 | 6/1954 | Dupkas . | |
| 3,104,686 | 9/1963 | Wise | 140/123.5 |
| 3,553,862 | 1/1971 | Hamu . | |
| 4,747,432 | 5/1988 | Chrisley | 140/102.5 |
| 4,868,600 | 9/1989 | Hays et al. | 355/259 |
| 5,124,749 | 6/1992 | Bares | 355/202 |
| 5,153,647 | 10/1992 | Barker et al. | 355/245 |
| 5,153,648 | 10/1992 | Lioy et al. | 355/247 |
| 5,300,992 | 4/1994 | Wayman et al. | 355/261 |
| 5,338,893 | 8/1994 | Edmunds et al. | 118/647 |

*Primary Examiner*—Robert Beatty

[57] ABSTRACT

An apparatus for tensioning wires in a wire module assembly is disclosed. Prior to placing the wire module in an operable position, the wires are attached to the wire module and the tension is adjusted to obtain the proper operating tension. This is accomplished by having a fixed and an adjustable wire anchor support. The adjustable anchor support is positioned between two fixed cross members and an adjusting mechanism passes through a cross member, the adjustable anchor support and the other cross member. When the adjusting mechanism is turned, the adjustable anchor support translates between the two cross members.

20 Claims, 4 Drawing Sheets

ELECTRODE WIRE TENSIONING FOR SCAVENGELESS DEVELOPMENT

Related patent applications entitled "Electrode Wire Support for Scavengeless Development" (D/95257), U.S. Ser. No. 08/568,108, Electrode Wire Positioning for Scavengeless Development" (D/95201) and U.S. Ser. No. 08/568,105, and "Electrode Wire Twisted Loop Mounting for Scavengeless Development" (D/95204) U.S. Ser. No. 08/568,107 are being filed on the same date as this patent application.

This invention relates generally to developer apparatus for electrophotographic printing. More specifically, the invention relates to supporting and pre-tensioning the electrode wires used in a scavengeless development system.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development". The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "transport" roll. The transport roll is typically in the form of a cylindrical sleeve rotating around a fixed assembly of permanent magnets. The carrier beads form chains extending from the surface of the transport roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor.

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a transport roll. In the development zone adjacent the electrostatic latent image on a photoreceptor, the electrostatic charge on the photoreceptor will cause the toner particles to be pulled from the developer to the photoreceptor. (As used in the claims herein, the phrase "developer material" shall be construed to mean either single-component or two-component developer material, or a portion thereof, such as the toner separated from the two-component developer material on a magnetic brush.)

An important variation to the general principle of development is the concept of "scavengeless" development. The purpose and function of scavengeless development are described more fully in, for example, U.S. Pat. No. 4,868,600. In a scavengeless development system, toner is made available to the photoreceptor by means of AC electric fields supplied by electrode structures, commonly in the form of wires extending across the photoreceptor, positioned within the nip between a donor roll and photoreceptor. The spacing between the wires and the donor roll is on the order of the thickness of the toner or less, under certain operating conditions the wires may be in contact with the donor roll. Because there is no physical contact between the development apparatus and the photoreceptor, scavengeless development is useful for devices in which different types of toner are supplied onto the same photoreceptor, as in "tri-level" or "recharge, expose, and develop" highlight or image-on-image color xerography.

A typical "hybrid" scavengeless development apparatus includes, within a developer housing, a transport roll, a donor roll, and an electrode structure. The transport roll operates in a manner similar to a development roll in a conventional development system, but instead of conveying toner directly to the photoreceptor, conveys toner to a donor roll disposed between the transport roll and the photoreceptor. The transport roll is electrically biased relative to the donor roll, so that the toner particles are attracted from the transport roll to the donor roll. The donor roll further conveys toner particles from the transport roll toward the photoreceptor. In the nip between the donor roll and the photoreceptor are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud, forming a toner powder image thereon.

The following disclosures may be relevant to various aspects of the present invention:

U.S. Pat. No. 4,868,600 Patentee: Hays et al. Issued: Sep. 19, 1989

U.S. Pat. No. 5,124,749 Patentee: Bares Issued Jun. 23, 1992

U.S. Pat. No. 5,300,992 Patentee: Wayman et al. Issued: Apr. 5, 1994

U.S. Pat. No. 5,153,648 Patentee: Lioy et al. Issued: Oct. 6, 1992

U.S. Pat. No. 5,338,893 Patentee: Edmunds et al. Issued: Aug. 16, 1994

U.S. Pat. No. 5,153,647 Patentee: Barker et al. Issued Oct. 6, 1992

The relevant portions of the foregoing disclosures may be briefly summarized as follows:

U.S. Pat. No. 4,868,600 describes a scavengeless development system in which toner is detached from a donor roll by AC electric fields applied to electrode structures which generate a controlled powder cloud of toner for the development of a latent image. The electrode structure is comprised of one or more thin wires which are placed in close proximity to the toned donor within the gap between the toned donor and the latent image. The wires are spaced from the donor structure by the thickness of the toner on the donor structure. The extremities of the wires are supported by the tops of end blocks on both ends of the donor roll which also support the donor roll for rotation. The wire extremities are attached so that they are slightly below a tangent to the donor with the toner layer surface.

U.S. Pat. No. 5,124,749 teaches a scavengeless development system in which the vibration of the electrode wires is dampened due to a unique wire support structure. The electrode wire is rigidly secured to a support with a wire anchor on one end and the donor roll at the other end. Damping the vibration of the electrode wire is accomplished by coating a portion of the electrode wire with a damping material. The damping material is applied to the wire and support between the anchor and the end of the support adjacent the donor roll.

U.S. Pat. No. 5,300,992 describes a method of supporting wire electrodes in a scavengeless development system. An off-axis wire mounting allows taut wires to make gentler contact with a rotating donor roll without tight tolerance requirements. The wires are made to "float", which means that there is no fixed anchor point for the wires.

U.S. Pat. No. 5,153,648 discloses a scavengeless development system with an electrode wire a support which contacts the wire in at least two points. The first support point is a lateral force pin which exerts a lateral or tangential force on the wire and is located close to the donor roll end. The second support is a horizontally mounted pin which exerts a vertical force on the wire and is placed under the wire at a location beyond that of the lateral force pin in the direction outwardly from the donor roll edge. An anchor point fixes the end of the wire beyond the horizontally mounted pin.

U.S. Pat. No. 5,338,893 teaches a scavengeless development apparatus with an electrode wire disposed between a donor roll and a latent image. The donor roll includes a section of increased diameter spaced away from the latent image and the electrode wire is disposed in sliding contact with the section of increased diameter to obtain a consistent spacing from the main length of the donor roll. A support structure with optional grooves, is located near the increased diameter ring area and supports the wire in the vertical direction after the wire passes over the increased diameter area. An anchor point is located beyond the support structure. A tensioning mechanism is provided so as to urge the electrode wires against the increased diameter area and the support structure.

U.S. Pat. No. 5,153,647 describes two different ways of positioning electrode wires in a development zone adjacent a photoconductive member in a scavengeless development system. One method of mounting the electrode wires is securing the ends of the electrode wires to an adjustable bow frame, which positions the electrode wires relative to the donor roll. The other method of mounting the electrode wires is fixing the wire ends to a rigid frame. One end of the wires is fixedly attached to the from and the other end may be adjustably attached to the frame.

All of the above patents are hereby incorporated by reference.

Hybrid scavangeless development utilizes very fine wires located in intimate contact with a rotating donor roll. In normal operation, the wire is electrically excited to cause the formation of a powder cloud in the photoreceptor/development nip. This excitation also attracts the wire to the donor roll. Thus in normal operation, a tensioned wire rides/rubs on a hard toner covered surface. In order for HSD systems to function properly, it is necessary to precisely locate the wires, to prevent the wire from vibrating like a musical instrument string, and to prevent the wire from wearing through at the donor roll ends. Precise control of the wire tension, wire to wire spacing, location of the wire array, and the spatial relationship between the wires and the donor roll ends has been demonstrated to prevent copy quality defects such as edge banding and strobing as well as to prevent wire wear at the donor roll ends and thus ensure maximal wire life.

SUMMARY

In accordance with one aspect of the present invention, there is provided an apparatus for developing a latent image recorded on a surface, including a housing storing a supply of developer material therein; a donor roll spaced apart from the surface and adapted to transport the developer material to a development zone adjacent the surface; a donor roll shaft on which the donor roll is mounted; a donor roll support, the donor roll shaft being rotatably mounted on said donor roll support; an electrode wire having a first end and a second end, the electrode wire being positioned in the space between the surface and the donor roll, the electrode wire being electrically biasable to detach the developing material from the donor roll to form a cloud of developer material in the space between the electrode wire and the surface with the developer material developing the latent image; a wire module comprising a frame including two side beams connected by a first cross member at a first end and a second cross member at a second end; a first anchor rigidly mounted to a first anchor block and a second anchor rigidly mounted to a second anchor block, the first end of the wire being attached to the first anchor and the second end of the wire being attached to the second anchor; the first anchor block being located between the first cross member and a first end of said donor roll; and an adjusting member which moves the first anchor block with respect to the first cross member in order to adjust the tension of the wire to a preselected tension.

Pursuant to another aspect of the present invention, there is provided an apparatus for tensioning electrode wires for a development system, including a wire having a first end and a second end; a wire module comprising a frame including two side beams connected by a first cross member at a first end of the frame and a second cross member at a second end of the frame; a first anchor located at the first end of the frame and rigidly mounted to a first anchor block which is laterally spaced from the first cross member and a second anchor located at the second end of the frame and rigidly mounted to a second anchor block, the first end of the wire being attached to the first anchor and the second end of the wire being attached to the second anchor; and an adjusting member which moves the first anchor block with respect to the first cross member in order to adjust the tension of the wire to a preselected tension.

The subject matter of this invention is a tensioning system for a wire module assembly. Prior to placing the wire module in an operable position, the wires are attached to the wire module and the tension adjusted to obtain the proper operating tension. This is accomplished by having a fixed and an adjustable wire anchor support. More than one wire may be attached to the support or an independent tensioning mechanism may be provided for each wire. Being able to pretension the wires results in easy mounting of the wire module assembly and the independent tensioning mechanism allows for ease of replacement of a defective wire. The tension of the wires may also be adjusted once the wire module assembly is in its operable position.

Other features of the present invention will become apparent as the following description proceeds and upon reference to the drawings, in which.

While the present invention will be described in connection with preferred embodiments thereof, it will be understood that it is not intended to limit the invention to these embodiment. On the contrary, it is intended to cover all alternatives, modifications, and equivalents as may be included within the spirit and scope of the invention as defined by the appended claims.

DETAILED DESCRIPTION

Figure 1:
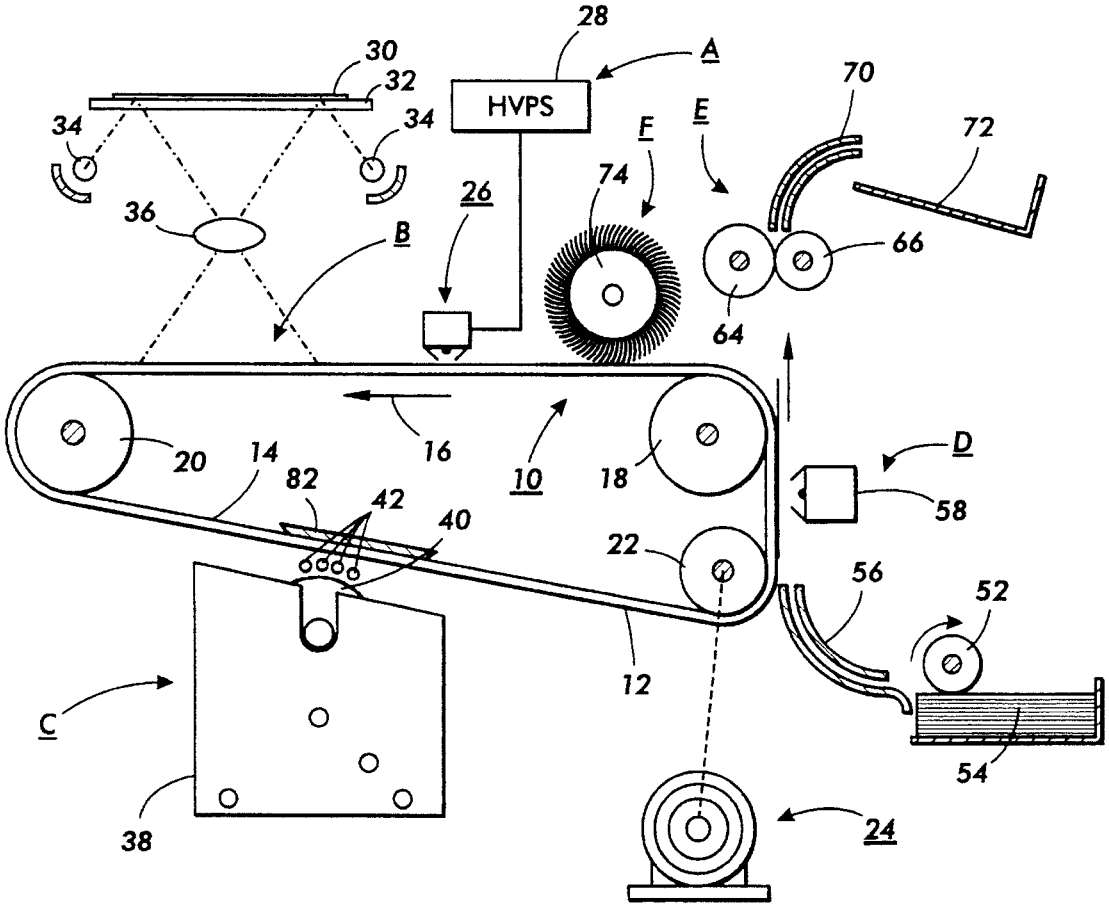
FIG. 1 is an elevational view of an electrophotgraphic printing apparatus in which the present invention may be embodied.

Referring initially to FIG. 1, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14 located on a flexible support member such as a MylarTM belt. Preferably the surface 12 is made from a selenium alloy. The substrate 14 is preferably made from a conductive metal oxide which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26. After charging, the charged area of surface 12 is passed to exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system housed in housing 38 develops the latent image recorded on the photoconductive surface. Preferably, development system includes a donor roller 40 and electrode wires positioned in the gap between the donor roll and photoconductive belt. Electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in a chamber of the housing 38, which stores a supply of developer material. The developer material is a two component developer material of at least magnetic carrier granules having toner particles adhering triboelectrically thereto. A transport roller disposed interiorly of the chamber of housing 38 conveys the developer material to the donor roller. The transport roller is electrically biased relative to the donor roller so that the toner particles are attracted from the transport roller to the donor roller.

After the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
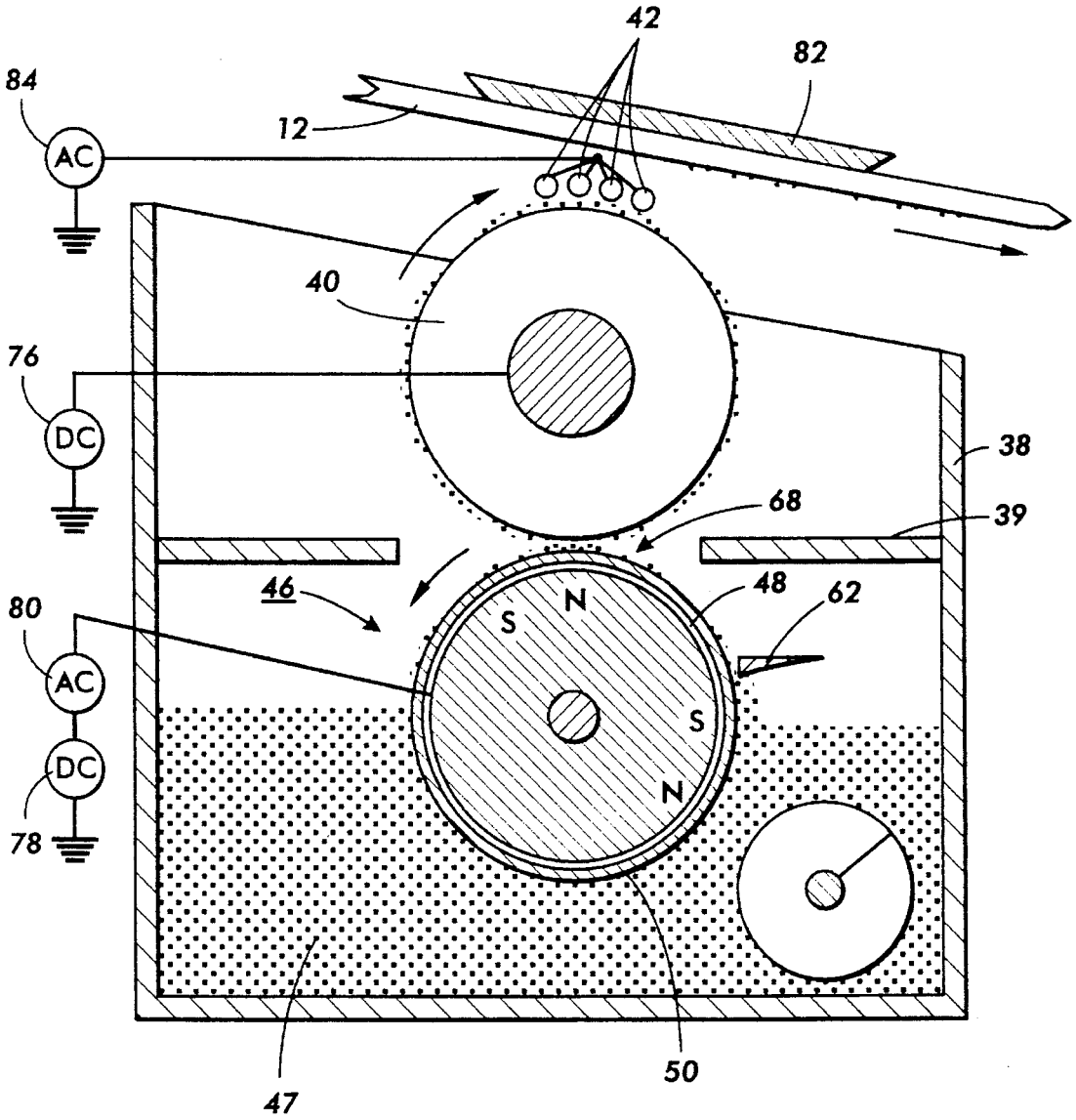
FIG. 2 is a a simplified elevational view of a hybrid scavengeless development station.

Referring now to FIG. 2, there is shown a hybrid-scavengeless development system in greater detail. Housing 38 defines a chamber for storing a supply of developer material 47 therein. A housing shelf 39 separates the developer housing into two sections; one associated with the donor roll and the other associated with the transport roll 46. Positioned in the bottom of housing 38 is a horizontal auger which distributes developer material uniformly along the length of transport roll 46, so that the lowermost part of roll 46 is always immersed in a body of developer material.

Transport roll 46 comprises a stationary multi-polar magnet 48 having a closely spaced sleeve 50 of non-magnetic material, preferably aluminum, designed to be rotated about the magnetic core 48 in a direction indicated by the arrow. Because the developer material includes magnetic carrier granules, the effect of the sleeve rotating through stationary magnetic fields is to cause developer material to be attracted to the exterior of the sleeve. A doctor blade 62 is used to limit the radial depth of developer remaining adherent to sleeve 50 as it rotates to the nip 68 between transport roll 46 and donor roll 40. The donor roll is kept at a specific voltage, by a DC power supply 76, to attract a thin layer of toner particles from transport roll 46 in nip 68 to the surface of donor roll 40. Either the whole of the donor roll 40, or at least a peripheral layer thereof, is preferably of material which has low electrical conductivity. The material must be conductive enough to prevent any build-up of electric charge with time, and yet its conductivity must be low enough to form a blocking layer to prevent shorting or arcing of the magnetic brush to the donor roll.

Transport roll 46 is biased by both a DC voltage source 78 and an AC voltage source 80. The effect of the DO: electrical field is to enhance the attraction of developer material to sleeve 50. It is believed that the effect of the AC electrical field applied along the transport roll in nip 68 is to loosen the toner particles from their adhesive and triboelectric bonds to the carrier particles. AC voltage source 80 can be applied either to the transport roll as shown in FIG. 2, or directly to the donor roll in series with supply 76.

Electrode wires 42 are disposed in the space between the belt 10 and donor roll 40. Four electrode wires are shown extending in a direction substantially parallel to the longitudinal axis of the donor roll 40. The electrode wires are made from of one or more thin (i.e. 25 to 125 micron diameter) steel, stainless steel or tungsten wires which are closely spaced from donor roll 40. The diameter of the wires shown in the figures is greatly exaggerated compared to the real wires for illustrative purposes. The distance between the wires and the donor roll 40 is approximately the thickness of the toner layer formed on the donor roll 40, or less. The wires are self-spaced from the donor roller by the thickness of the toner on the donor roller. The wire is supported in close proximity to the ends of the donor roll. This support locates the wires such that the wire and donor roll end maintain a specific required angular relationship. An alternating electrical bias is applied to the electrode wires by an AC voltage source 84. The applied AC establishes an alternating electrostatic field between the wires and the donor roller which is effective in detaching toner from the surface of the donor roller and forming a toner cloud about the wires.

At the region where the photoconductive belt 10 passes closest to donor roll 40, a stationary shoe 82 bears on the inner surface of the belt. The position of the shoe relative to the donor roll establishes the spacing between the donor roll and the belt. The spacing between the donor roll and photoconductive belt is preferably about 0.4 mm.

Another factor which has been found to be of importance is the speed with which the sleeve 50 is rotated relative to the speed of rotation of donor roll 40. In practice both would be driven by the same motor, but a gear train would be included in the drive system so that sleeve 50 is driven at a significantly faster surface velocity than is donor roll 40. A transport roll:donor roll speed ratio of 3:1 has been found to be particularly advantageous, and even higher relative speeds might be used in some embodiments of the invention. In other embodiments the speed ratio may be as low as 2:1.

Figure 3:
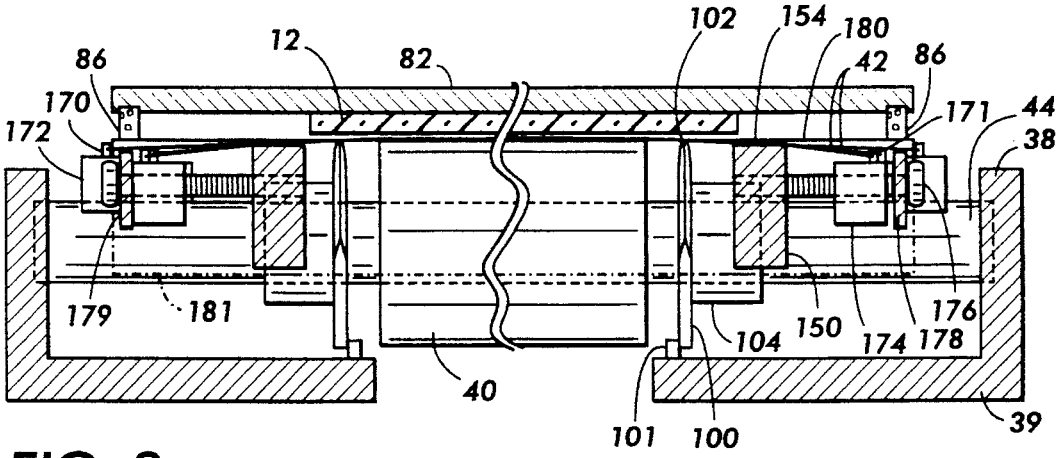
FIG. 3 is a side view of a novel wire module assembly.

FIG. 3 shows a novel wire module for supporting, tensioning and locating the wire electrodes 42 in a hybrid scavengeless development system. The following is a general description of the various components. As shown, there are four wires 42 in the wire module, however there may be fewer or more wires than four in any particular HSD system. For simplicity, only one of the wires and its supports will be referenced and discussed.

Donor roll 40 is supported by donor roll shaft 44. The donor roll shaft is rotatably supported by developer housing 298. A wire support 100, also referred to as an "R" bridge, is located in close proximity to the end of the donor roll and provides a narrow rounded and arc shaped stationary surface 102 for the electrode wire 42 to rest on. Affixed to the side of the R bridge is wire module mount 104 which enables mounting of the wire module to the R bridge and hence properly positions the wire module with respect to the donor roll. R bridge stops 101 are located on the developer housing shelf 39 on both ends of the donor roll so that the R bridge will be correctly positioned with respect to the donor roll ends.

A wire locating member 150, or "theta" bridge, attaches the wire module to the wire module mount 104. Preferably, the side supports of the theta bridge are configured to snap fit over the wire module mount for quick and easy attachment. Alternatively, the wire module may be affixed to the housing/module mounts using screws through the theta bridge. The theta bridge has grooves 154 on its upper surface to maintain the wire to wire spacing when the wires have been properly tensioned and positioned.

At the ends of the donor roll shaft is a wire tensioning system comprised of fixed wire anchor 170 and adjustable wire anchor 171, which are attached respectively to fixed wire anchor block 172 and adjustable wire anchor block 174. An adjustment member 176 is held in place by cross bridge 178 at one end and the theta bridge 150 at the other end. The cross bridges 178 and 179 are fixed to the side beams 180 and 181 so as to provide a rigid rectangular structure for the wire module assembly. The cross bridge 178 and theta bridge 150 on each end of the wire module are stationary with respect to each other. Both have a clearance hole for the adjustment screw 176. The wire anchor block 174 has a threaded interior hole and is mounted onto the adjustment screw 176.

It is important to locate the wires accurately in the photoreceptor to donor roll nip. This can be accomplished by many means. For example, docking pads 86, as shown in FIG. 3 could be attached to the shoe 82, which would rotate the wire module assembly to the correct angular location. Alternatively a slot (not shown) maybe provided in the wire module mount 104 which would mate with a similar projecting feature in the theta bridge 150 so as to provide the correct angular location of the assembly. Thus, the angular location of the wire module could be predetermined and fixed with respect to the donor roll. This would allow the wire module assembly to be snap mounted onto the developer housing and utilized at different predetermined angular locations.

Figure 4:
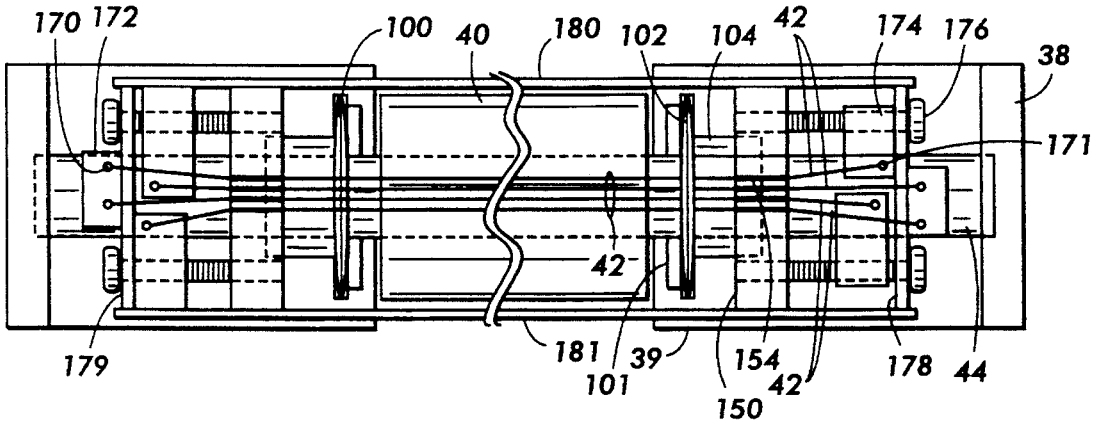
FIG. 4 is a plan view of the novel wire module assembly.

FIG. 4 provides a top view of the wire module, which will be used to discuss the adjustment and placement of the wire module assembly. The R bridge wire locating surface 102 and wire module mount 104 are properly positioned near the end of the donor roll 40 along the donor roll shaft 44. In a separate operation, the wire is attached to wire anchors 170 and 171 and the adjustment member 176 is turned to move the adjustable wire anchor block in such a way that the wire is properly tensioned. As the wire becomes taut, it is securely located in a groove 154 on the theta bridge 150 wire support surface. The entire wire module assembly is then mounted to the developer housing by mounting the theta bridge onto the wire module mount 104.

Figure 5:
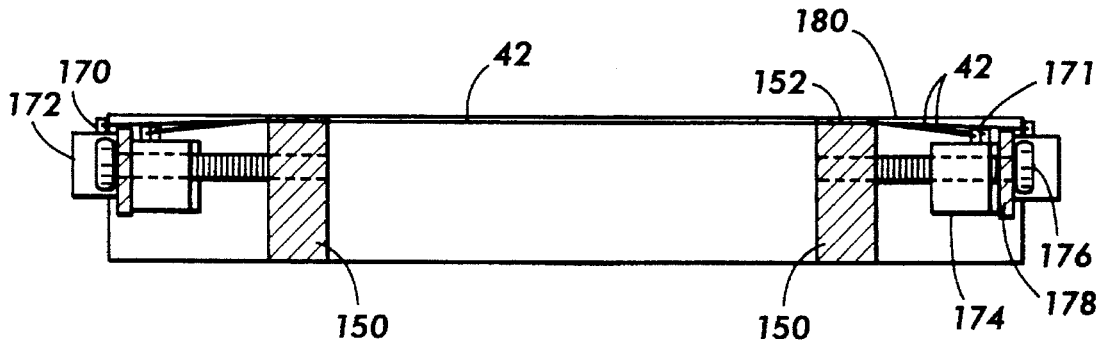
FIG. 5 is a side view of the novel wire module assembly prior to mounting on the housing.

FIG. 5 is a side view of the wire module prior to its attachment to the donor roll shaft. As explained above with respect to FIGS. 3 and 4, a one wire tensioning sub-system is comprised of fixed wire anchor 170 and adjustable wire anchor 171, which are attached to fixed wire anchor block 172 and adjustable wire anchor block 174, respectively. An adjustment member 176 is held in place by cross bridge 178 at one end and the theta bridge 150 at the other end. The theta bridges 150 and cross bridges 178 are fixed to side beams 180 and 181 and provide a rigid structure for the wire module assembly.

First, the wire 42 is attached to the wire anchors 170 and 171 and then the adjustment member 176 is turned to move the adjustable wire anchor block 172 so that the wire is properly tensioned. The adjustable wire anchor block is arranged so that the block will not rotate as the adjustment member is turned. Such an arrangement could be in the form of a post (not shown) projecting from the adjustable wire anchor block into the side beam. As the wire becomes taught, it is securely located in a groove 154 (see FIG. 4) located on the top surface 152 of the theta bridge 150.

In the embodiment shown, the adjustment member 176 is a screw which has the threaded end supported by the theta bridge and the the head end supported by the cross bridge. There are no threads on the part of the screw which come into contact with the theta bridge and the cross bridge so that when the screw is turned there is no lateral displacement of the screw with respect to the two fixed supports. However, there are threads in the area of the screw which contacts the hole through the adjustable wire anchor block which is internally threaded at the same gauge as the screw thread gauge. Thus, when the screw head is rotated only the adjustable wire anchor block moves to change the tension in the wire.

FIG. 4 shows a separate wire adjusting subsystem for each wire, but it should be appreciated that more than one wire could be attached to each wire tensioning sub-system, depending upon the system latitude with respect to tension tolerance. The wire tensioning system of the present invention also allows for adjusting the tension of the wires after the wire module has been mounted to the donor roll shaft. This is desirable due to the precise electrode wire positioning requirements of hybrid scavengeless development.

It is, therefore, apparent that there has been provided in accordance with the present invention, a scavengeless development wire support system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a surface, including:

a housing defining a chamber storing a supply of developer material therein;

a donor roll spaced apart from the surface and adapted to transport the developer material to a development zone adjacent the surface;

a donor roll shaft on which said donor roll is mounted;

a donor roll support, said donor roll shaft being rotatably mounted on said donor roll support;

an electrode wire having a first end and a second end, said electrode wire being positioned in the space between the surface and said donor roll, said electrode wire being electrically biasable to detach the developing material from said donor roll to form a cloud of developer material in the space between said electrode wire and the surface with the developer material developing the latent image;

a wire module comprising a frame including two side beams connected by a first cross member at a first end and a second cross member at a second end; a first anchor rigidly mounted to a first anchor block and a second anchor rigidly mounted to a second anchor block, the first end of the wire being attached to the first anchor and the second end of the wire being attached to the second anchor; the first anchor block being located between the first cross member and a first end of said donor roll; and an adjusting member which moves the first anchor block with respect to the first cross member in order to adjust the tension of the wire to a preselected tension.

2. The apparatus as claimed in claim 1, wherein the wire is tensioned to the preselected tension prior to the electrode wire being positioned in the space between the surface and said donor roll, the preselected tension being the tension which is necessary to enable the cloud of developing material to form.

3. The apparatus as claimed in claim 1, wherein said wire module further comprises:

a third cross member located between the first cross member and the first end of the donor roll such that the adjusting member connects the first cross member, first anchor block and third cross member, the first and third cross members being fixed.

4. The apparatus as claimed in claim 3, wherein said adjusting member is a screw with a head and a threaded shaft, the threaded shaft engages the anchor block and the anchor block moves along the threaded shaft when the head of the screw is turned.

5. The apparatus as claimed in claim 4, wherein the head of the screw is accessible so that the tension of the wire can be adjusted when the the electrode wire is positioned in the space between said donor roll and the surface.

6. The apparatus as claimed in claim 3, further comprising a fourth cross member located between the second cross member and a second end of the donor roll, the wire being longitudinally supported by the top surfaces of the third and fourth cross members.

7. The apparatus as claimed in claim 6, wherein the wire anchors lie in a first plane and the top surfaces of the third and fourth cross members lie in a second plane, where the first and second planes are spaced apart and parallel to one another.

8. The apparatus as claimed in claim 7, wherein a first wire support member is located between the first end of the donor roll and the third cross member and a second wire support member is located between the second end of the donor roll and the fourth cross member, wherein top surfaces of the first and second wire support members lie in a third plane, the third plane being located a first distance from the donor roll shaft and the second plane being located a second distance from the donor roll shaft, the first distance being greater than the second distance.

9. The apparatus as claimed in claim 8, wherein a first wire module mount is attached to the first wire support member and a second wire module mount is attached to the second wire support member, the first and second wire module mounts having said donor roll shaft passing through them and the wire module being mounted to the wire module mounts.

10. The apparatus as claimed in claim 6, wherein there are a plurality of wires, the top surfaces of third and fourth cross members having a plurality of spaced apart grooves, each wire being located in a separate groove to insure that a wire to wire distance is maintained in the space between the surface and said donor roll.

11. The apparatus as claimed in claim 10, further comprising a third anchor and a fourth anchor which support a second wire, the third anchor being located between the first cross member and the third cross member, the first and third anchors being being located at a greater lateral distance apart than the wire to wire distance.

12. The apparatus as claimed in claim 6, further comprising a third anchor and a fourth anchor which support a second wire, a fifth anchor and a sixth anchor supporting a third wire, and a seventh and an eighth anchor supporting a fourth wire, at least one of the anchors supporting each wire is adjustable with respect to the cross members.

13. The apparatus as claimed in claim 1, wherein the anchors are pins and the first end and the second end of the wire are loops which fit over the pins thereby attaching the wire to the anchor blocks.

14. The apparatus as claimed in claim 1, wherein the wire module is mounted to the donor roll shaft.

15. An apparatus for developing a latent image recorded on a surface, including:

a housing defining a chamber storing a supply of developer material therein;

a donor roll spaced apart from the surface and adapted to transport the developer material to a development zone adjacent the surface;

a donor roll shaft on which said donor roll is mounted;

a donor roll support, said donor roll shaft being rotatably mounted on said donor roll support;

an electrode wire having a first end and a second end, said electrode wire being positioned in the space between the surface and said donor roll, said electrode wire being electrically biased to detach the developer material from said donor roll to form a cloud of developer material in the space between said electrode wire and the surface with the developer material developing the latent image;

means for supporting the electrode wire including a frame having two side beams connected by a first cross member at a first end and a second cross member at a second end; a first anchor rigidly mounted to a first anchor block and a second anchor rigidly mounted to a second anchor block, the first end of the wire being attached to the first anchor and the second end of the wire being attached to the second anchor; the first anchor block being located between the first cross member and a first end of said donor roll;

means for maintaining the wire position located between the first anchor and the first end of the donor roll and also located between the second cross member and a second end of the donor roll, the wire being longitudinally supported by said maintaining means; and means for adjusting including an adjusting member passing through the first cross member, first anchor block and third cross member so that when the adjusting member is adjusted, the first anchor block moves laterally with respect to the first cross member, adjusting tension in the wire to a preselected tension.

16. An apparatus for tensioning electrode wires for a development system, comprising:

a wire having a first end and a second end;

a wire module comprising a frame including two side beams connected by a first cross member at a first end of the frame and a second cross member at a second end of the frame; a first anchor located at the first end of the frame and rigidly mounted to a first anchor block which is laterally spaced from the first cross member and a second anchor located at the second end of the frame and rigidly mounted to a second anchor block, the first end of the wire being attached to the first anchor and the second end of the wire being attached to the second anchor; and an adjusting member which moves the first anchor block with respect to the first cross member in order to adjust the tension of the wire to a preselected tension.

17. The apparatus as claimed in claim 16, wherein said wire module further comprises:

a third cross member spaced apart from the first cross member such that an adjusting member connects the first cross member, the first anchor block and the third cross member; and a fourth cross member, the wire being supported by the top surfaces of the third and fourth cross members.

18. The apparatus as claimed in claim 17, wherein the top surfaces of the third and fourth cross members lie in a first plane and the first and second anchors lie in a second plane, the first plane and second planes are spaced apart and parallel to one another.

19. The apparatus as claimed in claim 17, wherein there are a plurality of electrode wires, the top surfaces of the third and fourth cross members having a plurality of grooves, each electrode wire being located in a separate groove to insure a wire to wire distance.

20. The apparatus as claimed in claim 16, wherein the wire module is detachably mounted to the housing.

* * * * *